United States Patent [19]

Kawamura et al.

[11] 4,149,131

[45] Apr. 10, 1979

[54] ELECTROMAGNETIC RELAY

[75] Inventors: Siyoutaro Kawamura, Oobu; Mitsuru Ueda, Chita; Makoto Imaeda, Kariya, all of Japan

[73] Assignee: Nippondenso Co., Ltd., Kariya, Japan

[21] Appl. No.: 753,859

[22] Filed: Dec. 23, 1976

[30] Foreign Application Priority Data

Jan. 17, 1976 [JP] Japan ..... 51-4101[U]

[51] Int. Cl.[2] ..... H01H 9/02

[52] U.S. Cl. ..... 335/202; 335/278

[58] Field of Search ..... 335/128, 202, 276, 278

[56] References Cited

U.S. PATENT DOCUMENTS

| | | | |
|---|---|---|---|
| 3,153,711 | 10/1964 | Naybor | 335/128 |
| 3,295,078 | 12/1966 | Hrynewycz | 335/128 X |
| 3,321,722 | 5/1967 | Cohen | 335/128 |

*Primary Examiner*—George Harris

*Attorney, Agent, or Firm*—Cushman, Darby & Cushman

[57] ABSTRACT

An electromagnetic relay installed in an automobile. In this electromagnetic relay, a casing to house an electromagnetic coil therein is used as part of a magnetic circuit for reducing the size and weight of the electromagnetic relay. By doing this, there may be provided an electromagnetic relay whose construction is well adapted for use in automatic mechanical assembly of the relay.

13 Claims, 18 Drawing Figures

FIG. 12(A)
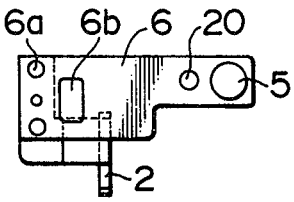
FIG. 12(B)
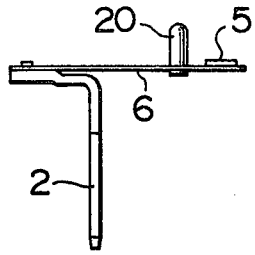
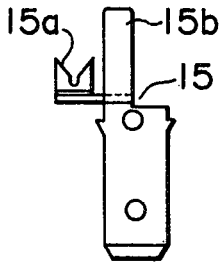
FIG. 13
FIG. 14
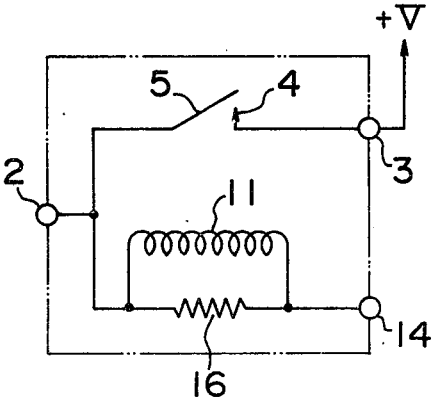
FIG. 15
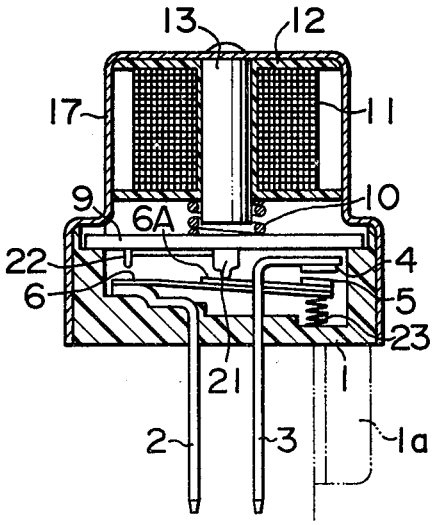

ELECTROMAGNETIC RELAY

BACKGROUND OF THE INVENTION

This invention relates to improvements in construction of an electromagnetic relay installed in an automobile or the like.

According to a prior art electromagnetic relay, a magnetic circuit included therein consists of a core, a yoke, and a movable iron piece serving as an armature plate. It is intended that the armature plate be attracted due to a magnetic flux produced in a coil wound around a core. In this case, an electric current path consists of a point holder serving as a terminal, contacts caulked in or welded to the point holder, an armature spring serving as a return spring, and contacts caulked in or welded to the armature spring. A cover used for the relay is made of an iron, resin or the like.

Meanwhile, there has been a demand that a relay of this type be assembled to various parts in varying directions, so that difficulty is confronted with an automatic mechanical assembly of the relay. A magnetic flux produced by an electromagnetic coil portion passes through a yoke of an 'L' shape. In this case, however, the relay suffers from considerable leakage of a magnetic flux passing through portions other than the yoke, and hence a lowered efficiency. Still furthermore, a ratio of an unoccupied space to the entire volume of a relay is considerably large, thus resulting in an increase in size of a relay as well as difficulty in reducing its weight. In addition, because of a large ratio of an unoccupied space to the volume of a relay, there arises a danger of dust being introduced into an unoccupied space, upon assembly, thus leading to a defective contacting condition of contacts and hence to unsatisfactory quality.

SUMMARY OF THE INVENTION

It is a first object of the present invention to provide an electromagnetic relay, in which an electromagnetic coil portion is encompassed with a casing which in turn is used as a path for a magnetic flux.

It is a second object of the present invention to provide an electromagnetic relay, in which a contact drive mechanism is positioned under the electromagnetic coil portion within the casing, the aforesaid contact drive mechanism having contacts adapted to be driven due to a magnetic force produced in a core in an electromagnetic coil portion.

It is a third object of the present invention to provide an electromagnetic relay which may dispense with a yoke and, reduce the amount of a leaking magnetic flux as well as provide a compact size and a reduced weight.

According to the present invention, the casing itself is used as a path for a magnetic flux, with the result that a yoke integral with a cover may be provided, thereby reducing the number of parts and a manufacturing cost. In addition, the casing covers the entire peripheral surface of an electromagnetic coil portion, so that a leaking magnetic flux may be minimized, and thus a strong armature plate drive force may be achieved. Furthermore, an electromagnetic coil portion is covered with a casing of a high thermal conductivity, and in addition a contact drive mechanism is provided under the electromagnetic coil portion, thereby allowing reduction in size and weight of a relay. Still furthermore, an electromagnetic coil portion and a contact drive mechanism may be assembled within a casing in this order from one direction, thus facilitating automatic assembly.

BRIEF DESCRIPTION OF THE DRAWINGS

FIGS. 12A and 12B are plan view and a front view of a spring and a terminal;

FIG. 13 is a lefthand side-view of a terminal;

FIG. 14 is a diagram of an electric circuit representing the second embodiment of the electromagnetic relay according to the present invention; and FIG. 15 is a longitudinal cross section view of the aforesaid electromagnetic relay.

DESCRIPTION OF THE PREFERRED EMBODIMENTS

Figure 1:
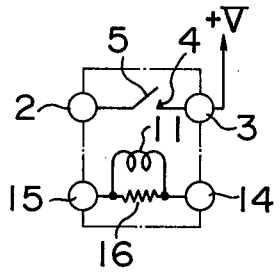
FIG. 1 is an electric circuit representing a first embodiment of an electromagnetic relay according to the present invention.
Figure 2A:
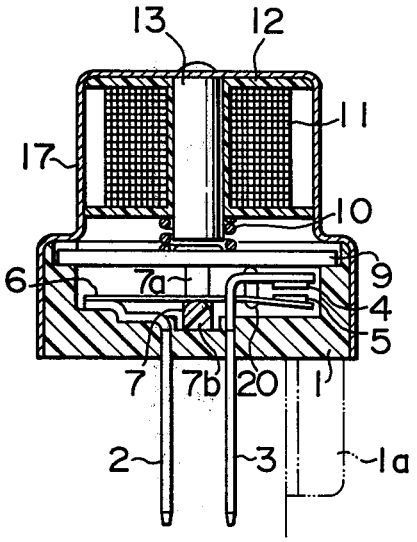
FIGS. 2A, 2B are front views, partly in cross section, of the relay of FIG. 1.
Figure 6:
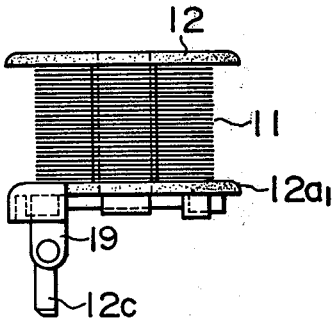
FIGS. 6 and 7 are a lefthand side-view and a bottom view of the electromagnetic coil portion.
Figure 7:
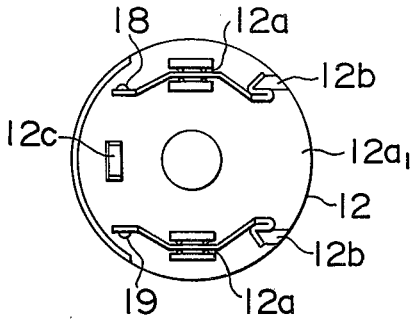

The first embodiment of an electromagnetic relay according to the present invention will now be described in more detail in conjunction with FIGS. 1 to 13. Referring first to FIG. 2A, shown at 1 is a base made of resin, at 2 a terminal, at 3 a terminal, to which is secured a fixed contact 4 serving as an external terminal as well. Shown at 5 is a movable contact secured to a spring 6. The spring 6 is secured to a terminal 2. Shown at 7 is a spacer which consists essentially of a clamp portion 7*a* and a spacer portion 7*b*. Shown at 9 is a movable iron piece serving as an armature plate and engaging the clamp portion 7*a* (spring). Shown at 10 is a return spring, and at 11 a coil wound on a spool 12. Shown at 13 is a core secured to a casing 17. Thus, an electromagnetic coil portion consists of the coil 11, spool 12 and core 13. Shown at 16 is a resistor for use in lowering an inverse voltage in the coil 11, which resistor is connected between coils, and at 14, 15 are terminals connected to the resistor 16. Shown at 18, 19 are terminals of the coil 11. Fusion-jointed under pressure to the terminals 18, 19 are ends of the coil 11, which ends are led through cut-away portions 12*b* in the spool 12. (FIG. 7). The terminals 18, 19 are held in grooves 12*a* provided in the spool 12. Shown at 20 is a drive bar (This will be referred to as a spacer hereinafter.) which is made of resin. The lower end of the spacer is inserted in a hole in the spring 6 and thermally caulked therin for rigid connection, while the upper end of the spacer 20 abuts the armature plate 9. After assembly, a terminal 19 (FIG. 7) contacts a terminal 14 (FIG. 5), while a terminal 18 contacts a terminal 15, respectively, for electric connection, thus serving as external terminals. The terminal 14 and terminal 15 are connected to the opposite ends (starting and terminating ends) of the coil 11, respectively.

Figure 5:
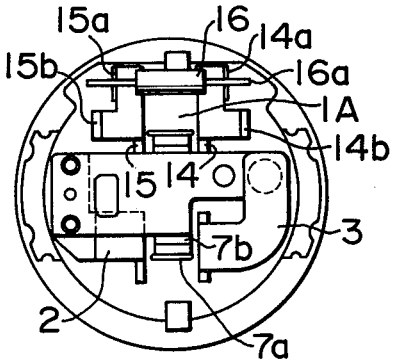
FIG. 5 is a plan view of the aforesaid relay excluding an electromagnetic coil portion, casing and armature plate.
Figure 8:
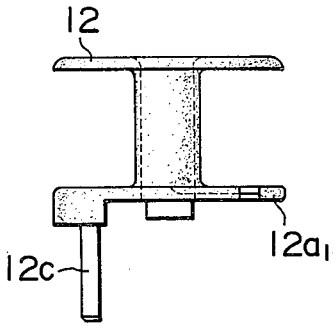
FIGS. 8 and 9 are a lefthand side-view and a bottom view of a spool.
Figure 9:
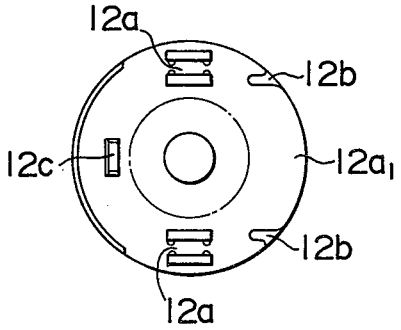
Figure 10:
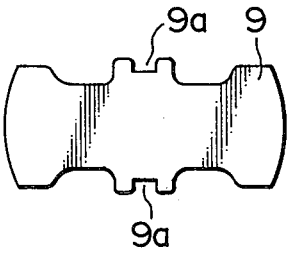
FIG. 10 is a plan view of an armature plate.
Figure 11A:
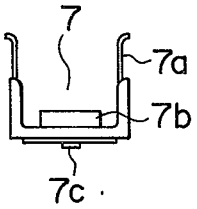
FIGS. 11A and 11B are a lefthand side-view and a bottom view of a spacer.
Figure 11B:
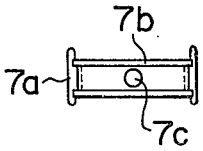

Detailed constructions of respective parts will be described hereunder. FIGS. 12A and 12B show the spring 6 and terminal 2. Shown at 6a is a welded portion and at 6b a hole for adjusting a spring characteristic of the spring 6. FIGS. 11A and 11B shown the spacer A7 which consists of a clamp portion 7a made of a stainless steel and a spacer portion 7b that is made of resin and coupled to the clamp portion 7a according to thermal caulking. Shown at 7c is a projection on the spacer portion 7b. The top end of the clamp portion 7a is of 'T' shape and engages a cut-away portion 9a in the armature plate 9, so that when the armature plate 9 is moved (attracted) upwards, then the spacer 7 is moved upwards in cooperation therewith, thereby raising the spring 6. FIGS. 8 and 9 show the detailed construction of the spool 12. Defined in a lower flange portion $12a_1$ of the spool 12 is cut-away portions 12b for directing lead wires from the opposite ends of the coil 11 therethrough. Furthermore, defined in and formed with the flange portion $12a_1$ are a groove 12a holding terminals 18, 19 integrally and a guide 12c adapted to locate the spool, upon assembly. The guide 12c, upon assembly, is inserted into a guide hole 1A provided in the base 1 (FIG. 5). FIG. 13 shows a detailed construction of the terminal 15 (the terminal 14 is of a symmetric shape to the terminal 15), in which there are provided notches 15a (14a) of a triangular shape, into which lead pins 16a projecting from the opposite ends of the resistor 16 are inserted. The resistor 16 is not shown in FIG. 2A and positioned on the back side of a drawing sheet. Shown at 15b (14b) are projections, with which the terminals 18, 19 and terminals 14, 15 are brought into contact, when assembled.

Figure 2B:
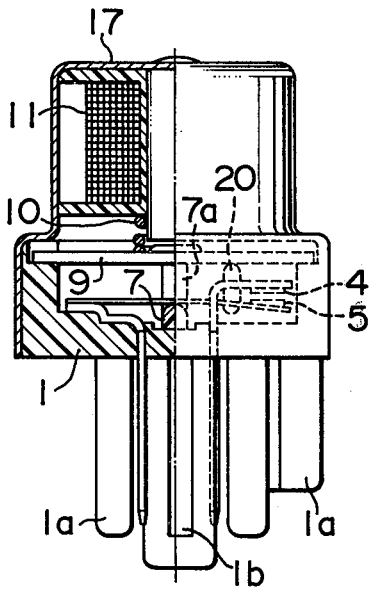
Figure 3:
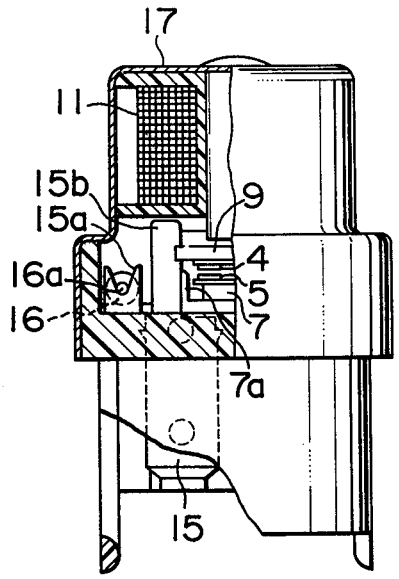
FIG. 3 is a lefthand side-view, partly in cross section, of the aforesaid relay.
Figure 4:
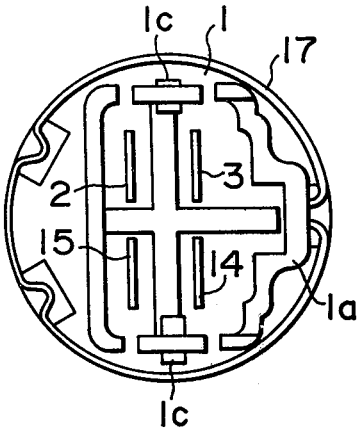
FIG. 4 is a bottom view of the aforesaid relay.

FIGS. 4 and 2B show a bottom portion and side portion of a connector 1a integral with an undersurface of the base 1. Provided in the side portion of the connector 1a is a groove 1b for retaining the connector 1a in position. Further provided in the base 1 is a punched hole 1c for use in forming the groove 1b.

FIGS. 14 and 15 show the second embodiment of the present invention. In an electric circuit shown in FIG. 14, grounding terminals are combined into a single terminal, thereby reducing the number of terminals to be directed on the outside of the base 1. As shown in cross section in FIG. 15, the shape of a drive member attached to the armature plate 9 is varied. More particularly, in place of the spacer 7 and drive bar 20 in FIG. 2, a drive projection 21 made of resin and a projection 22 for preventing the relay from being assembled in an inverse direction are secured to the armature plate 9. A movable spring plate 6 is made of a spring plate having a weaker spring force than that of a spring shown in the first embodiment of FIG. 2, while a contacting plate 6A having a slightly increased thickness is secured to the surface of the spring plate 6, and a movable contact 5 is secured to the contacting plate 6A. In addition, an auxiliary coil spring 23 is provided under the movable contact 5 for urging an end portion of the spring plate 6 including the movable contact 5 upwards. In addition, the spool 12 is devoid of the guide 12c such as shown in FIG. 6.

With the aforesaid arrangement, a spring force of the spring plate 6 is lowered, so that a spring force of the return spring 10 may be lowered considerably. An auxiliary coil spring 23 is provided for preventing the lowering in quickness and positiveness of the actuation (closing and opening operations) of the movable contact 5 relative to the fixed contact, due to a lowered spring force of the spring plate 6.

Upon assembly of the armature plate 9, if the left and right hand parts are inversed, the projection 22 abuts the top end of the terminal 3 mounting the fixed contact 4 thereon, so that the armature plate 9 is lifted, thus making it impossible to assemble same. As a result, there may be insured a proper assembly in a proper direction.

Description will now be given of the operation of the relay having the aforesaid arrangement. A magnetic flux produced in the coil 11 magnetizes the core 13 and casing 17, so that the movable iron piece 9 serving as an armature plate may be attracted thereto. At this time, the clamp portion 7a secured to the movable iron piece 9 cooperates with the movable iron piece 9 being moved upwards, so that the spring 6 is raised by the spacer 7, thus closing the contacts 4 and 5. When the coil 11 is de-energized, the return spring 10 urges the armature plate 9 downwards, thereby opening the contacts 4 and 5. When the armature plate 9 is lowered by means of the return spring 10, the spacer 20 abuts the armature plate 9, thereby preventing delayed opening of the contacts 4 and 5. In other words, the spacer 7 for lifting the spring 6 is positioned on the side of a fulcrum thereof, while the spacer 20 for lowering the spring 6 is positioned on the side of the contacts 4 and 5 away from the fulcrum, so that the delay in opening the contacts 4, 5 due to the elasticity of the spring 6 may be avoided. Thus, when the armature plate 9 is lowered, then the contacts 4, 5 may be quickly opened by means of the spacer 20 positioned close to the contacts 4, 5, thus insuring an extended service life for the contacts. In addition, the armature plate 9 and spring 6 are separately provided, and the aforesaid both members are linked by means of the spacer 7 and spacer 20, so that the contact drive mechanism may be made compact and housed in a casing in a satisfactory manner. In addition, the armature plate 9 is positioned in the close vicinity of the coil 11, so that the spring 6 may be driven by effectively utilizing an attracting force of the coil 11. Furthermore, a current path running through the contacts 4 and 5 between the terminal 2 and the terminal 3 is short and hence less in the number of contact-resisting portions, with the result that a voltage drop and heat generation in the contacting portions may be minimized. The coil 11 is connected to the terminals 14, 15 in such a manner that the ends of the coil 11 are connected to terminals 18, 19 made of spring material, by using a fusion technique, and then the terminals 18, 19 are brought into contact with the terminals 14, 15, upon assembly. As a result, soldering may be avoided, and cleaning of scattered flux at the time of soldering may be also avoided, thus facilitating automatic assembly of a relay. Still furthermore, a gap between the contacts 4 and 5 is dependent on a height of the terminal 3 driven into the base 1 therefrom, so that the quality control for the height of the terminal alone may well lead to a consistent performance of the contacts. Furthermore, a pressure to be applied between the contacts 4 and 5 depends on a gap between the armature plate 9 and the casing 17, so that quality control for dimensions of the base alone may well provide a uniform contacting pressure for the contacts. As a result, adjusting operations may be saved to a great extent.

Meanwhile, in the aforesaid embodiments, a normally opened type relay is shown. However, it is needless to mention that the terminal 3 and contact 4 may be positioned under the spring 6, thereby modifying the relay into a normally closed type relay. In addition, as an alternative, the resistors 16 provided at the opposite ends of the coil 11 may be diodes, varistors or the like. If an inverse voltage in the coil 11 may be neglected, the resistor 16 may be omitted. Alternatively, the shape of casing 17 should not necessarily be of a cylindrical shape, but of a circular or polygonal shape, and concave or convex portions or irregularity may be provided on the surface of the casing for ease of holding same. In addition, for the same result, coating or covering of resin may be one of solution to this problem. In addition, the terminals 2, 14, 15, serving as external terminals and terminal 3 are shown in the form of flat pins. However, pins having a circular cross section may be used therefor. Yet furthermore, external terminals in the form of pins may be avoided, while a lead wire is directed from the base 1 so as to connect a connector with the tip of the lead wire. Still furthermore, the base 1 is manufactured as a terminal mount, and then connecting terminals are provided thereon by using screws and washers for connection to external wires. In addition, part of the casing 17 or base 1 may be projected outwardly, and then an attaching hole is provided in the portion thus projected, thereby providing an attaching stay. Futhermore, the relay according to the present invention may be modified into a buzzer by changing its wiring. In addition, in the embodiments, electric contacts 4, 5, spring 6, armature plate 9, spacer 7 and spacer 20 are used as components of a contact drive mechanism. However, as well known, the spring 6 may be directly connected to the armature plate 9, without using spacer 7 and spacer 20. Otherwise, the spring 6 may be connected to the armature plate 9 by means of a single spacer. In addition, in the aforesaid embodiments terminals 2, 14, 15 and terminal 3 are driven into holes provided in the base 1 made of resin. However, these may be embedded therein upon molding.

What is claimed is:

1. An electromagnetic relay comprising:

a cylindrical casing having an opening at one end thereof;

a core provided in the form of a bar and having one end thereof secured to the other end of said cylindrical casing;

a spool having a through-hole in an axial direction thereof, into which said core in the form of a bar is inserted for attachment;

an electromagnetic coil wound about said spool and having both ends thereof led out from a bottom surface of said spool and electrically connected to contact terminals, said bottom surface of said spool having cutout portions through each of which a said end of said coil passes for connection to said respective contact terminal, with said terminal being disposed on said bottom surface opposite to said coil;

an armature plate positioned in parallel with a bottom surface of said core and attracted towards the bottom surface of said core due to an electromagnetic force produced when said electromagnetic coil is energized;

drive members for switching, from an open condition to a closed condition, a movable contact and a fixed contact due to an attracting force applied to said armature plate; and a base for securing thereon outer terminals having said fixed contact and current-feeding terminals attached to said cylindrical casing at said opening thereof and movably supporting said armature plate in a space defined between a top surface of said base and the bottom surface of said core, said base being mounted to provide electrical connection of said contact terminals with said current feeding terminals to feed a current to said electromagnetic coil by contacting said contact terminals with said current feeding terminals, said current feeding terminals having ends in said casing, said ends each having aligned V-shaped notches for receiving and retaining one end of a resistance means.

2. An electromagnetic relay as set forth in claim 1, wherein said cylindrical casing forms a part of a magnetic path running through said core and said armature plate.

3. An electromagnetic relay as set forth in claim 2, wherein said cylindrical casing comprises a large diameter portion and a small diameter portion, presenting a stepped or shoulder portion therebetween, with said large diameter portion being formed at the opening of said casing, while said armature plate is positioned between said shoulder portion and said base.

4. An electromagnetic relay as set forth in claim 1, wherein said drive members include a spring plate having said movable contact secured thereto, and a projecting member attached to said armature plate, thereby deflecting said spring plate due to the movement of said armature plate being attracted, for switching from an open condition to a closed condition and vice versa, of said movable contact and said fixed contact.

5. An electromagnetic relay as set forth in claim 4, wherein said drive members further include a drive bar which is positioned in the close vicinity of said movable contact on said spring plate, so that upon release from an attracted condition, said drive bar presses such a portion of said spring plate, which is close to said movable contact, thereby allowing a quick return action of said movable contact.

6. An electromagnetic relay as set forth in claim 1, wherein a spring is provided between said spool and said armature plate for urging said armature plate towards the top surface of said base.

7. An electromagnetic relay as set forth in claim 6, wherein said spring is provided in the form of a coil.

8. An electromagnetic relay comprising:

a cylindrical casing having an opening at one end thereof;

a core provided in the form of a bar and having one end thereof secured to the other end of said cylindrical casing;

a spool having a through-hole in an axial direction thereof, into which said core in the form of a bar is inserted for attachment;

an electromagnetic coil wound about said spool and having both ends thereof electrically connected to contact terminals which lead out said both ends towards a bottom surface of said spool, said bottom surface of said spool having cutout portions through each of which a said end of said coil passes for connection to said respective contact terminal, with said terminal being disposed on said bottom surface on a side opposite to said coil;

a base for securing thereon outer terminals having a fixed contact, and current feeding terminals, and attached to said cylindrical casing, at the opening therof, said base being mounted to provide electrical connection of said contact terminals with said current feeding terminals to feed a current to said electromagnetic coil by bringing the same into contact with each other, said current feeding terminals having ends in said casing, said ends each having aligned V-shaped notches for receiving and retaining one end of a resistance means; and drive means provided between said base and said core and actuated in accordance with a movement of an armature plate attracted towards the end face of said core by an electromagnetic force produced when said electromagnetic coil is energized, thereby switching, from an open condition to a closed condition, said movable contact relative to said fixed contact.

9. An electromagnetic relay comprising:

a cylindrical casing having an opening at one end thereof;

a core provided in the form of a bar and having one end thereof secured to the other end of said cylindrical casing;

a spool having a through-hole in an axial direction thereof, into which said core in the form of a bar is inserted for attachment;

an electromagnetic coil wound about said spool, said spool having a bottom surface and a pair of spaced cutout portions with each end of said coil passing through said cutout portion to contact current feeding terminals;

an armature plate positioned in parallel with the end face of said core and attracted towards the end face of said core due to an electromagnetic force produced when said electromagnetic coil is energized;

drive members for moving a movable contact to a fixed contact due to the movement of said armature plate being attracted, thereby switching, from an open condition to a closed condition, said movable contact relative to said fixed contact;

a base rigidly supporting outer terminals having said fixed contact and attached to the opening of said cylindrical casing, said base movably supporting said armature plate in a space defined between the top end of said base and the end face of said core and having current feeding terminals for energizing said electromagnetic coil said current feeding terminals having ends in said casing, said ends each having aligned V-shaped notches for receiving and retaining one end of a resistance means.

10. An electromagnetic relay for use in a vehicle, comprising:

a cylindrical casing having an opening at one end thereof and made of a metal;

a core provided in the form of a bar and having one end thereof secured to the other end of said cylindrical casing;

a spool having a through-hole in an axial direction thereof, into which said core in the form of a bar is inserted for attachment;

an electromagnetic coil wound about said spool and having both ends thereof electrically connected to contact terminals which lead out said both ends towards the bottom surface of said spool, said bottom surface of said spool having cutout portions through each of which a said end of said coil passes for connection to said respective contact terminal, with said terminal being disposed on said bottom surface on a side opposite to said coil;

an armature plate positioned in parallel with the end face of said core and attracted towards the end face of said core by an electromagnetic force produced by said electromagnetic coil when it is energized;

drive members for electrically connecting a movable contact with a fixed contact, when said armature plate is attracted to said core by said electromagnetic force; and an insulating base supporting outer terminals having said fixed contact and attached to the opening of said cylindrical casing, said base movably supporting said armature plate in a space defined between the top surface of said base and the end face of said core and having current feeding terminals for energizing said electromagnetic coil, said current feeding terminals having ends in said casing, said ends each having aligned V-shaped notches for receiving and retaining one end of a resistance means.

11. An electromagnetic relay as set forth in claim 10, wherein said drive members include a spring plate having said movable contact secured thereto and a projecting member attached to the center portion of said armature plate, thereby deflecting said spring plate due to the movement of said armature plate being attracted and switching, from an open condition to a closed condition, said movable contact and said fixed contact.

12. An electromagnetic relay as set forth in claim 11, wherein said drive members include a coil spring for urging the free end of said spring plate upwardly and elevating an electrical connection between said movable and fixed contacts.

13. An electromagnetic relay as set forth in claim 12, wherein said drive members include a projection provided in the same plane as that of said projecting member on said armature plate, thereby preventing assembling of said relay in an inverse direction.

* * * * *